US012391347B2

(12) United States Patent
Allen et al.

(10) Patent No.: US 12,391,347 B2
(45) Date of Patent: Aug. 19, 2025

(54) BOAT FENDER HANGER

(71) Applicants: Randall Jay Allen, Lake Havasu City, AZ (US); Coral Belinda Allen, Lake Havasu City, AZ (US)

(72) Inventors: Randall Jay Allen, Lake Havasu City, AZ (US); Coral Belinda Allen, Lake Havasu City, AZ (US)

( * ) Notice: Subject to any disclaimer, the term of this patent is extended or adjusted under 35 U.S.C. 154(b) by 495 days.

(21) Appl. No.: 18/081,680

(22) Filed: Dec. 14, 2022

(65) Prior Publication Data

US 2023/0182873 A1 Jun. 15, 2023

Related U.S. Application Data

(63) Continuation-in-part of application No. 29/828,627, filed on Feb. 28, 2022, now Pat. No. Des. 1,005,210.

(60) Provisional application No. 63/289,532, filed on Dec. 14, 2021.

(51) Int. Cl.
*B63B 59/02* (2006.01)

(52) U.S. Cl.
CPC ..... *B63B 59/02* (2013.01)

(58) Field of Classification Search
CPC ..... B63B 59/00; B63B 59/02
USPC ..... 114/219
See application file for complete search history.

(56) References Cited

U.S. PATENT DOCUMENTS

| | | | | |
|---|---|---|---|---|
| 3,167,287 | A | 1/1965 | Collins | |
| 4,526,124 | A | 7/1985 | Hartwall | |
| 4,843,994 | A | 7/1989 | Wilson | |
| 5,074,506 | A | 12/1991 | Larsen | |
| 6,349,661 | B1 * | 2/2002 | Dusek | E02B 3/26 114/219 |
| 10,184,220 | B1 | 1/2019 | McGilvery | |

OTHER PUBLICATIONS

Compass Marine Fender Bag, Retrieved from Internet, Retrieved on Sep. 21, 2021 <URL: https://www.compassmarine.co.uk/fender-bags-c102x1360332>.

* cited by examiner

*Primary Examiner* — Lars A Olson

(57) ABSTRACT

A boat fender hanger is an apparatus used to hold a fender alongside a boat in order to protect the boat while docking. The apparatus includes a hanging mechanism, a fender-retaining sleeve, and a suspension band. The hanging mechanism is used to readily attach and detach the apparatus from the side of a boat. The fender-retaining sleeve is used to secure a fender within the apparatus. The suspension band is used to position the fender-retaining sleeve offset from the hanging mechanism in order to prevent the hanging mechanism and the fender-retaining sleeve from functionally interfering with each other.

14 Claims, 10 Drawing Sheets

BOAT FENDER HANGER

The current application claims a priority to the U.S. provisional patent application Ser. No. 63/289,532 filed on Dec. 14, 2021.

The current application is a continuation-in-part (CIP) application of the U.S. design application Ser. No. 29/828,627 filed on Feb. 28, 2022.

FIELD OF THE INVENTION

The present invention generally relates to a hanger for a marine fender. More specifically, the present invention is a device that secures to the side of a boat while holding a fender to protect the boat.

BACKGROUND OF THE INVENTION

Within the marine industry many individuals have come up with various ways to attempt to protect their boats when tying their boat up at the dock or from accidental contact with other boats within the vicinity. Usually, fenders are hung alongside the boat to protect it from damage by hanging the fenders with rope to a cleat or other mounting point. In order to mount the fender alongside the boat via a cleat, the individual must have a good baseline knowledge of tying knots. This can hinder various individuals' ability to properly hang the fender from the side of the boat, creating frustrations with the proper height needed and understanding the proper knot to secure the rope holding the fender to the cleat. Further, once the individual has properly secured the fender to the cleat, the rope used to tie the fender to the cleat usually wraps around the cleat several times not leaving a good amount of room for the cleat to be used to tie the boat to the dock, which is its main purpose.

An objective of the present invention is to provide users with a boat fender hanger, to help hold fenders alongside a boat without needing knowledge of complex knots or using valuable space around the cleat. The present invention intends to provide users with a device that can protect the side of a boat by utilizing various attachment points along the side of the boat. In order to accomplish that, a preferred embodiment of the present invention comprises a mounting section and a hanger body. Further, the mounting section allows the present invention to utilize various surfaces and attachment points to properly secure to the side of a boat. Thus, the present invention is a boat fender hanger that can hang anywhere alongside a boat to protect it while docking, ensuring the cleat of the boat stays unobstructed for utilization while securing the boat to the dock.

SUMMARY OF THE INVENTION

The present invention is a boat fender hanger to help with protecting the side of a boat while docking. The present invention seeks to provide users with a device that can hold a fender within a pocket alongside a boat without taking up space on the boat cleat. In order to accomplish this the present invention comprises a mounting section that allows for the boat fender hanger to be secured to the boat side in a variety of locations. Further, the hanger body allows the present invention to stay positioned and hold a fender alongside the boat edge. Thus, the present invention is a boat fender hanger that can hang anywhere alongside a boat to protect it while docking, ensuring the cleat of the boat stays unobstructed for utilization while securing the boat to the dock.

DETAILED DESCRIPTION OF THE INVENTION

Figure 1:
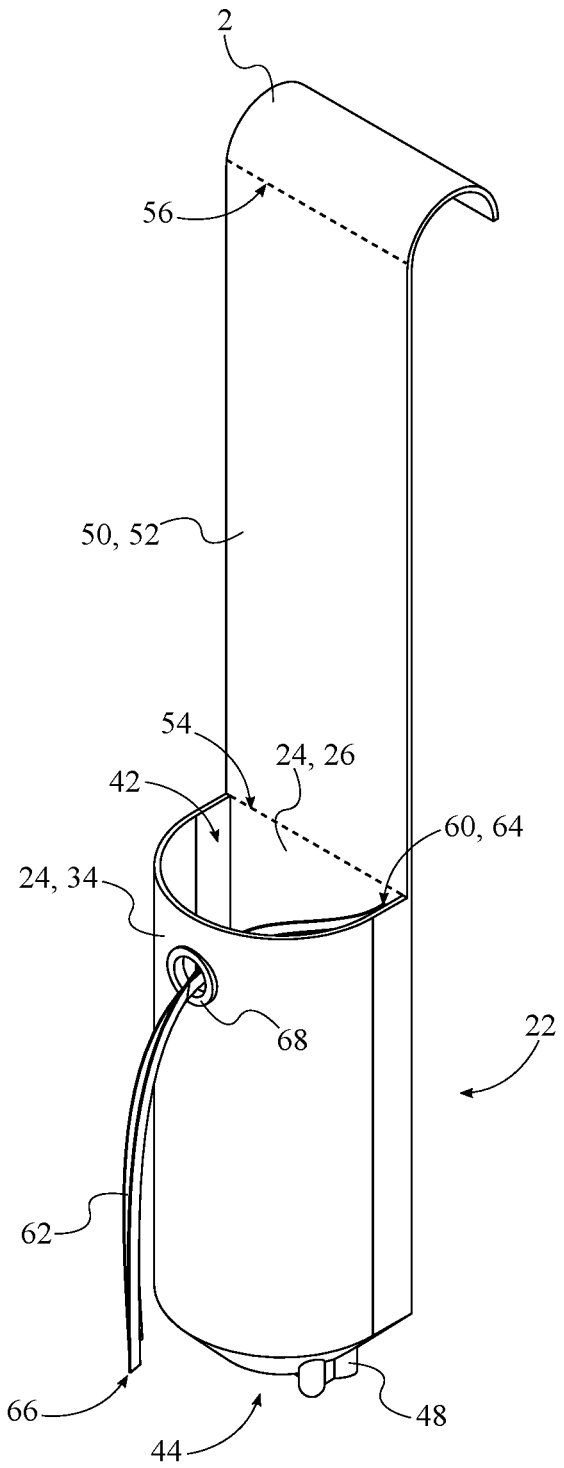
FIG. 1 is a perspective view of an exemplary embodiment of the present invention.
Figure 2:
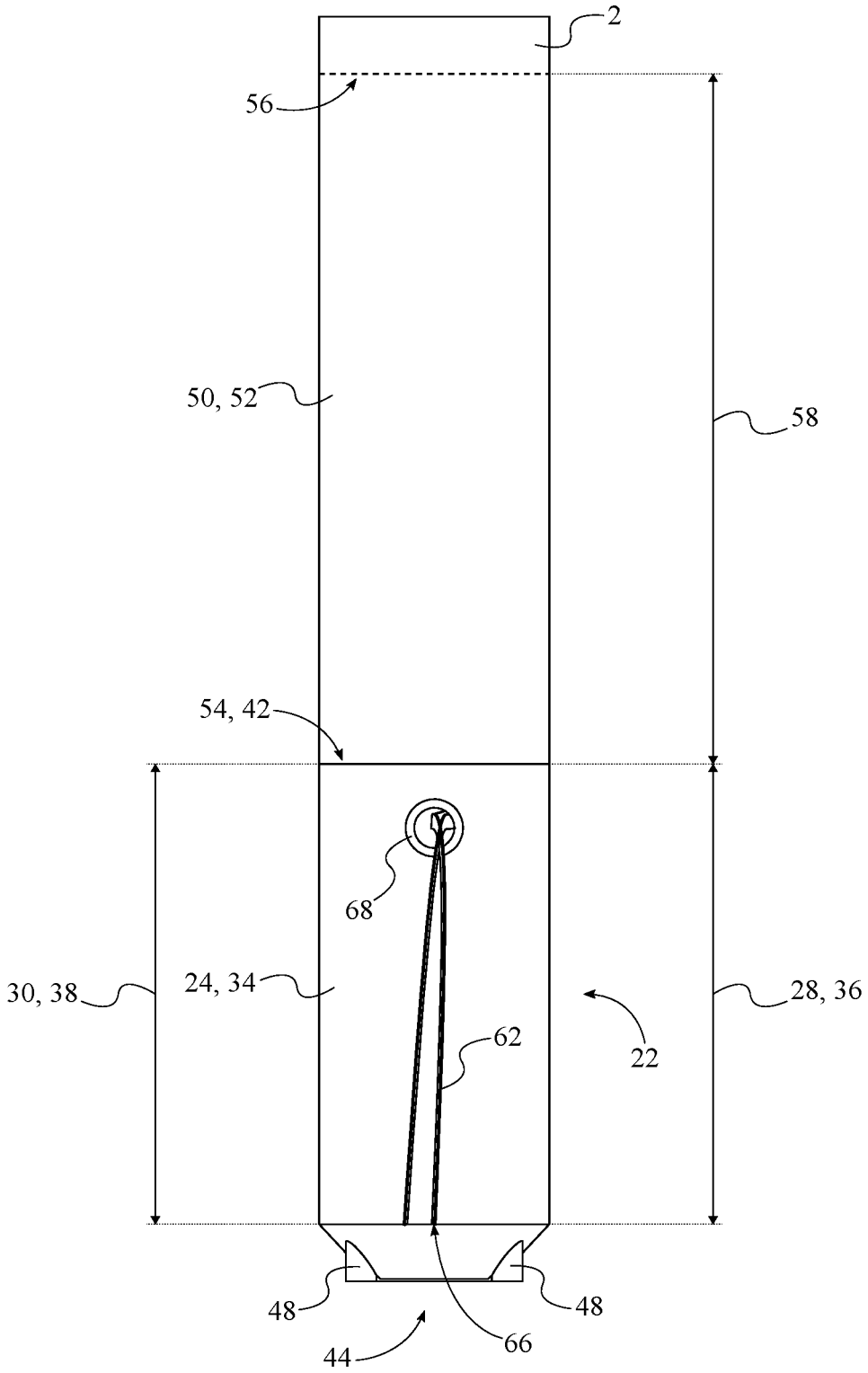
FIG. 2 is a front view of the exemplary embodiment of the present invention.

All illustrations of the drawings are for the purpose of describing selected versions of the present invention and are not intended to limit the scope of the present invention.

As can be seen in FIGS. 1 through 7, the present invention is a boat fender hanger that is used to hold fenders at various locations alongside a boat. The present invention is used to free up the space surrounding a boat cleat for other purposes instead of being used to tie a fender in place. Thus, the present invention comprises a hanging mechanism 2, a fender-retaining sleeve 22, and a suspension band 50. The hanging mechanism 2 allows the present invention to readily attached or readily detach from the side of a boat. The fender-retaining sleeve 22 is used to retain a fender and to secure the fender in place alongside a boat. The suspension band 50 provides the necessary separation between the hanging mechanism 2 and the fender-retaining sleeve 22, which prevents the hanging mechanism 2 and the fender-retaining sleeve 22 from functionally interfering with each other. The fender-retaining sleeve 22 and the suspension band 50 are preferably made of a marine-grade canvas and are preferably a blue color in order to visually contrast a typical whitish color of a boat.

As can be seen in FIGS. 1 through 7, the general configuration of the aforementioned components allows the present invention to efficient and effective secure fenders in place alongside a boat so that the boat is able to use the fenders as bumpers as the boat approaches and parks against a dock. The fender-retaining sleeve 22 comprises a sleeve body 24, an open sleeve end 42, and a closed sleeve end 44. The sleeve body 24 defines an overall structure of the fender-retaining sleeve 22. The open sleeve end 42 is used to receive a fender from the top of the fender-retaining sleeve 22, while the closed sleeve end 44 is used to support the fender with the bottom of the fender-retaining sleeve 22. Thus, the open sleeve end 42 and the closed sleeve end 44 are positioned opposite to each other along the sleeve body 24. In addition, the suspension band 50 comprises a band body 52, a proximal band end 54, and a distal band end 56. The band body 52 defines an overall structure of the suspension band 50. The proximal band end 54 is used to properly position the fender-retaining sleeve 22, while the distal band end 56 is used to properly position the hanging mechanism 2. Thus, the proximal band end 54 and the distal band end 56 are positioned opposite to each other along the band body 52. More specifically, the proximal band end 54 is laterally connected to the sleeve body 24, adjacent to the open sleeve end 42, so that the fender-retaining sleeve 22 is tethered in place by the suspension band 50. The hanging mechanism 2 is also integrated into the band body 52, adjacent to the distal band end 56, which allows the hanging mechanism 2 to be positioned offset from the fender-retaining sleeve 22.

As can be seen in FIGS. 1 through 7, the fender-retaining sleeve 22 can be constructed to better secure a fender alongside the boat. Thus, the sleeve body 24 may comprise an elongated backing 26 and a lateral bracing panel 34. The elongated backing 26 is an elongated piece of canvas that remains in a relatively flat shape to brush-up or brace against an outer side surface of the boat. The elongated backing 26 and the band body 52 are preferably a single elongated piece of contiguous material. The lateral bracing panel 34 is a larger piece of canvas that braces a fender from three sides as the elongated backing 26 braces the fender from one side. Moreover, the elongated backing 26 comprises a first lengthwise backing edge 28 and a second lengthwise backing edge 30, while the lateral bracing panel 34 comprises a first lengthwise panel edge 36 and a second lengthwise panel edge 38. A panel width 40 between the first lengthwise panel edge 36 and the second lengthwise panel edge 38 is greater than a backing width 32 between the first lengthwise backing edge 28 and the second lengthwise backing edge 30. The narrow width of the elongated backing 26 is used to maintain its relatively flat shape while bracing one side of a fender, and the broad width of the elongated backing 26 is used to maintain its relatively curved shape while bracing three sides of the fender. The construction of the fender-retaining sleeve 22 is completed by connecting the first lengthwise panel edge 36 along the first lengthwise backing edge 28 and by connecting the second lengthwise panel edge 38 along the second lengthwise backing edge 30. More specifically, the first lengthwise panel edge 36 is preferably stitched along the first lengthwise backing edge 28, and the second lengthwise panel edge 38 is preferably stitched along the second lengthwise backing edge 30.

As can be seen in FIGS. 1 through 7, the fender-retaining sleeve 22 can also be configured to better receive and brace a bottom portion of a fender. Thus, the fender-retaining sleeve 22 may further comprise a protrusion-receiving hole 46. A fender typically has a nub protruding from its bottom end, and the protrusion-receiving hole 46 allows the nub to pass through the closed sleeve end 44 as the rest of the fender's bottom end is supported by the closed sleeve end 44. The protrusion-receiving hole 46 traverses through the closed sleeve end 44 and is centrally positioned to the closed sleeve end 44, which configures the protrusion-receiving hole 46 at a portion of the present invention that typically receives a bottom nub of a fender.

As can be seen in FIGS. 1 through 7, the fender-retaining sleeve 22 can also be shaped to better receive and brace a bottom portion of a fender. Thus, the fender-retaining sleeve 22 may further comprise a plurality of pinch points 48, which are each fabric portion of the fender-retaining sleeve 22 that has been pinched and stitched together in order to shape a bottom portion of the fender-retaining sleeve 22 in a particular way. The plurality of pinch points 48 is integrated between the sleeve body 24 and the closed sleeve end 44 and is peripherally positioned around the closed sleeve end 44 so that the sleeve body 24 is configured to taper towards the closed sleeve end 44 by the plurality of pinch points 48. The tapering of the sleeve body 24 towards the closed sleeve end 44 is used to better receive and brace a tapering bottom portion of a fender.

As can be seen in FIGS. 1 through 7, the present invention can also be configured to better secure a fender within the fender-retaining sleeve 22. Thus, the present invention may further comprise a cord anchor 60, at least one securing cord 62, and at least one cord eyelet 68. The cord anchor 60 is used to fix one end of the at least one securing cord 62 in place within the fender-retaining sleeve 22. The cord anchor 60 is connected within the sleeve body 24, adjacent to the closed sleeve end 44, which prevents the at least one securing cord 62 from interfering as a fender enters and is received by the fender-retaining sleeve 22. The at least one cord eyelet 68 is used to guide the at least one securing cord 62 out of the fender-retaining sleeve 22 in order to further tie down the at least one securing cord 62. The at least one cord eyelet 68 is integrated into the sleeve body 24, adjacent to the open sleeve end 42, and is positioned offset from the cord anchor 60 about the sleeve body 24, so that the at least one securing cord 62 is able to diametrically traverse within the fender-retaining sleeve 22 while tying down a top portion of a fender and while engaging the at least one cord eyelet 68 to hold the at least one securing cord 62 in place. The at least one securing cord 62 is looped, knotted, woven, or a combination thereof through an eyelet of a fender in order to secure the fender within the fender-retaining sleeve 22. The at least one securing cord 62 comprises a proximal cord end 64 and a distal cord end 66, which are opposing ends of the at least one securing cord 62. The proximal cord end 64 is connected onto the cord anchor 60, and the at least one securing cord 62 is positioned through the at least one cord eyelet 68 in order to position the distal cord end 66 external to the sleeve body 24. This arrangement allows the at least one securing cord 62 to traverse through and out of the sleeve body 24 while tying down a fender within the fender-retaining sleeve 22 and not obstructing a path of the fender entering the fender-retaining sleeve 22 with the at least one securing cord 62.

In some embodiments of the present invention, the at least one securing cord 62 is a plurality of securing cords, which are used to further secure a fender within the fender-retaining sleeve 22. The distal cord end 66 of each of the plurality of securing cords is connected onto the cord anchor 60 so that the cord anchor 60 can act as a nexus for the plurality of securing cords.

In some embodiments of the present invention, the at least one cord eyelet 68 is a plurality of cord eyelets, which are used to guide the at least one securing cord 62 in multiple selectable paths through the fender-retaining sleeve 22. The plurality of cord eyelets is radially positioned about the cord anchor 60, which allows a user to select one path from multiple evenly-distributed paths in order to best accommodate and best guide the at least one securing cord 62 about a fender and out of the fender-retaining sleeve 22.

Figure 8:
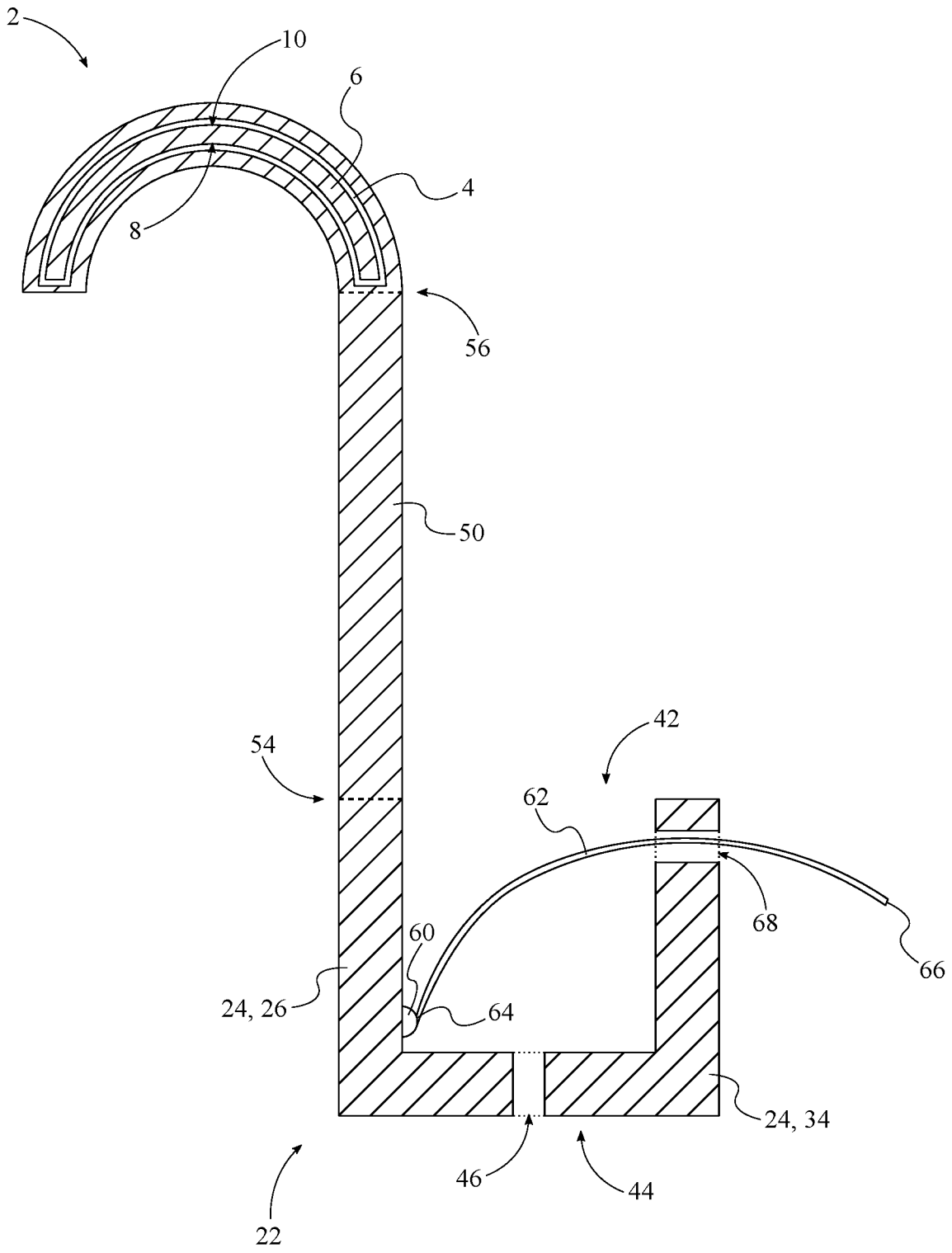
FIG. 8 is a schematic cross-sectional view of a first embodiment of the present invention.

As can be seen in FIG. 8, a first embodiment of the hanging mechanism 2 is used to attach and detach the present invention from an elongated side part of a boat. Thus, the first embodiment of the hanging mechanism 2 comprises an internal pocket 4 and a hooking bracket 6. The hooking bracket 6 is preferably made of metal and is used to grapple some portion of a boat. The hooking bracket 6 may be an upside-down-J-shaped bracket that is sized to fit over and around common stainless-steel rails found along the sides of most boats. The hooking bracket 6 may alternatively be a rectangular-C-shaped bracket that is sized to fit over and around the square tubing found on most pontoon boats. The internal pocket 4 is used to retain the hooking bracket 6. Thus, the internal pocket 4 is integrated into the band body 52, adjacent to the distal band end 56, and the hooking bracket 6 is positioned within the internal pocket 4. In addition, the sleeve body 24 is oriented away from the band body 52, while the hooking bracket 6 is oriented away from the band body 52, opposite to the sleeve body 24, which allows the present invention to attach to a boat on one side of the suspension band 50 and allows the present invention to retain a fender on the other side of the suspension band 50. More specifically, the hooking bracket 6 may comprise a concave bracket portion 8 and a convex bracket portion 10. The convex bracket portion 10 is oriented away from the sleeve body 24, while the concave bracket portion 8 is oriented towards the sleeve body 24 so that the concave bracket portion 8 is able to press against an elongated side part of a boat by the weight of the present invention and its retained fender and consequently hangs the present invention and its retained fender from the elongated side part of the boat.

Figure 9:
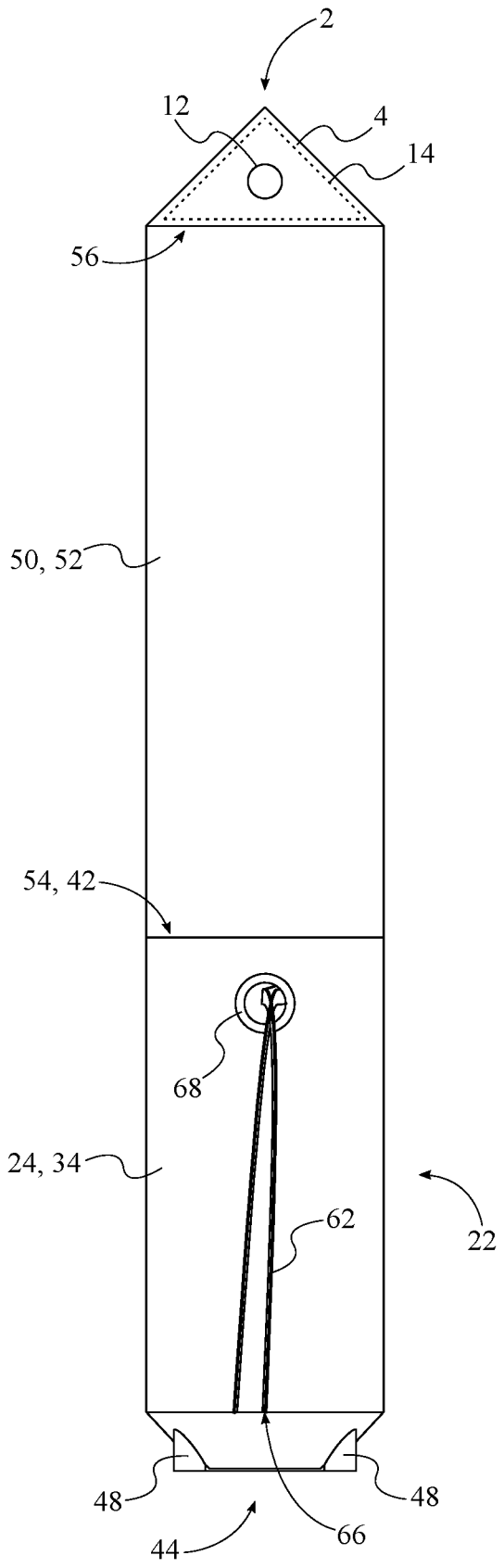
FIG. 9 is a front view of a second embodiment of the present invention.

As can be seen in FIG. 9, a second embodiment of the hanging mechanism 2 is used to attach and detach the present invention from a spring-loaded pin mount on a custom boat. Thus, the second embodiment of the hanging mechanism 2 comprises an internal pocket 4, a hooking hole 12, and a support plate 14. The hooking hole 12 is used to receive a spring-loaded pin mount, and the support plate 14 is used to improve the structural integrity of the hooking hole 12. The support plate 14 is preferably made of metal and is preferably shaped as a triangle with one of its vertexes pointed away from the fender-retaining sleeve 22. The internal pocket 4 is used to retain the support plate 14. Thus, the internal pocket 4 is integrated into the band body 52, adjacent to the distal band end 56, and the support plate 14 is positioned within the internal pocket 4. The hooking hole 12 traverses through band body 52 and the support plate 14 so that the present invention is able to hang from a spring-loaded pin mount as the present invention with its retained fender applies their entire weight onto the spring-loaded pin mount.

Figure 10:
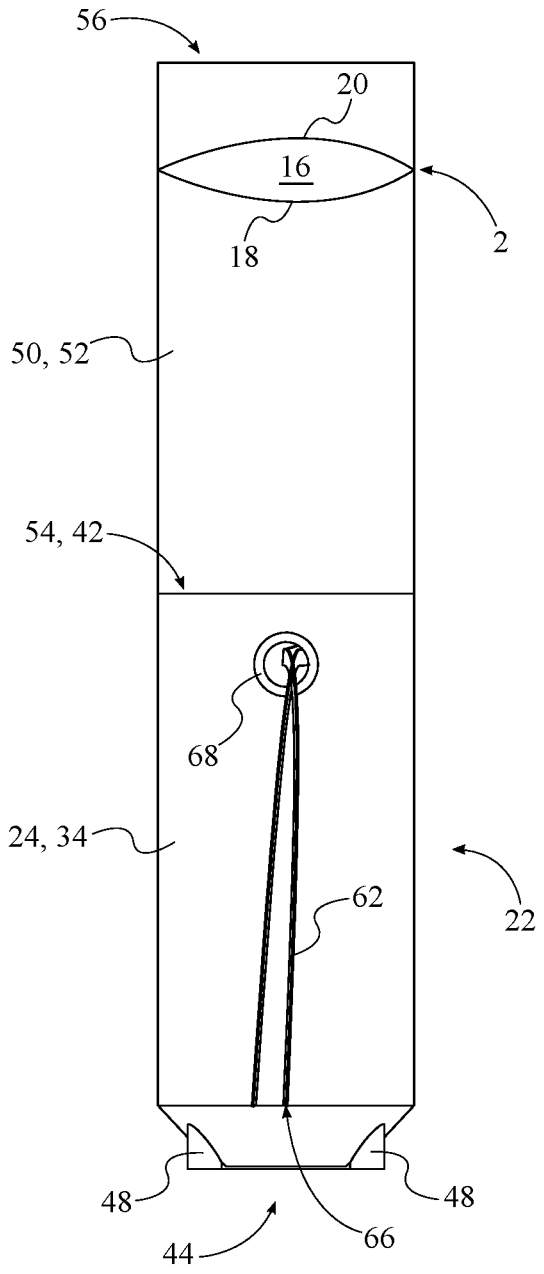
FIG. 10 is a front view of a third embodiment of the present invention.

As can be seen in FIG. 10, a third embodiment of the hanging mechanism 2 is used to attach and detach the present invention from a boat cleat. Thus, the third embodiment of the hanging mechanism 2 comprises a hooking slit 16, which is an elongated cut sized to receive a boat cleat. The hooking slit 16 traverses normal through the band body 52 so that the present invention is able to hang from a boat cleat as the present invention with its retained fender applies their entire weight onto the boat cleat. In order to better receive a boat cleat with the hooking slit 16, the hooking slit 16 is positioned perpendicular to a band length 58 of the suspension band 50 and is positioned adjacent to the distal band end 56. More specifically, the hanging mechanism 2 may further comprise a first elongated liner 18 and a second elongated liner 20, which are two rigid members that are used to structurally reinforce the hooking slit 16. The first elongated liner 18 and the second elongated liner 20 are integrated into the band body 52 so that the first elongated liner 18 and the second elongated liner 20 are held in place alongside the hooking slit 16. Moreover, the first elongated liner 18 is positioned adjacent and along the hooking slit 16, while the second elongated liner 20 is positioned adjacent and along the hooking slit 16, opposite to the first elongated liner 18, so that both sides of the hooking slit 16 are structurally reinforced as the present invention and its retained fender applies its entire weight onto a boat cleat through the hooking slit 16.

SUPPLEMENTAL DESCRIPTION

Figure 3:
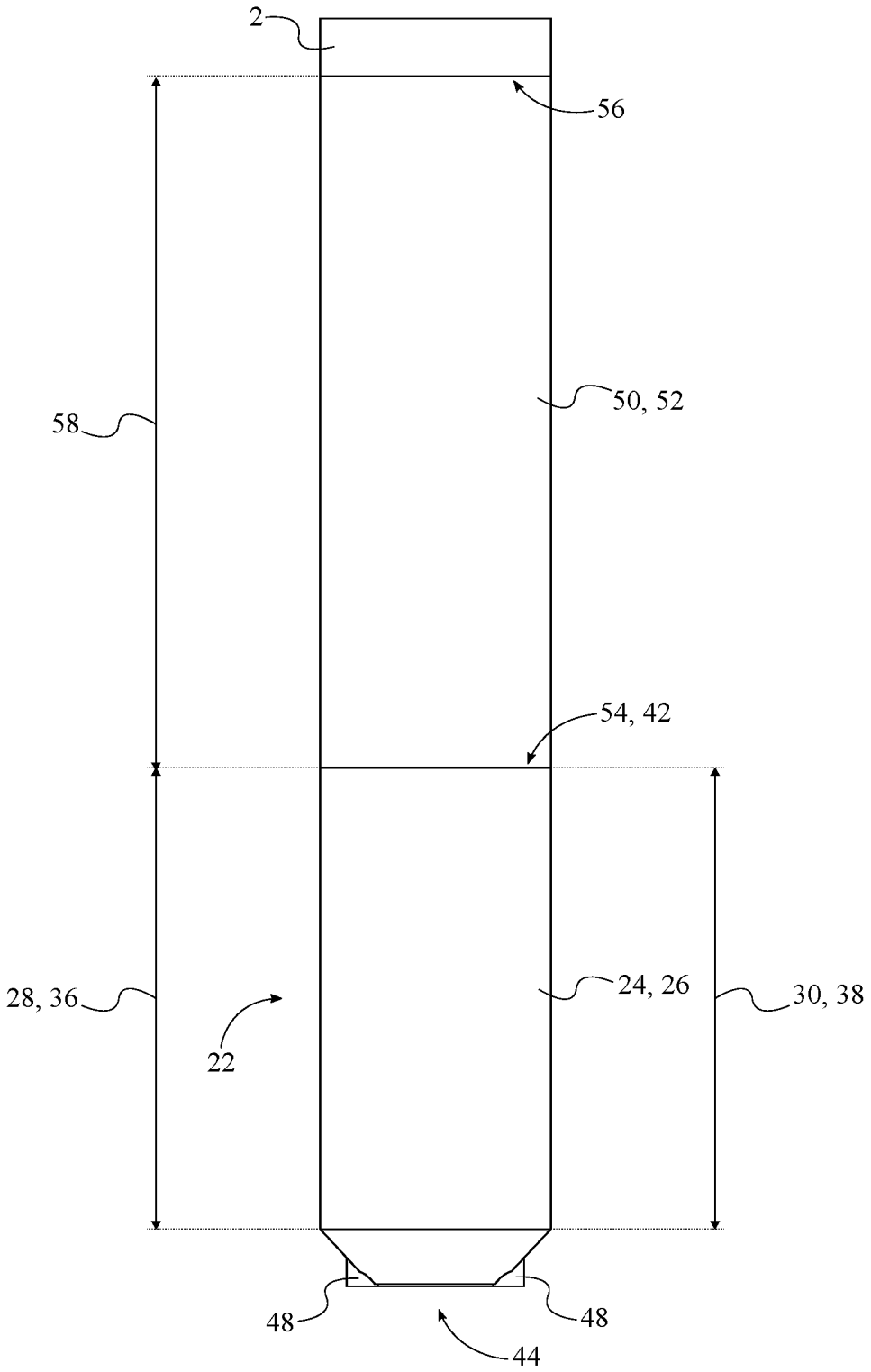
FIG. 3 is a rear view of the exemplary embodiment of the present invention.

As shown in FIG. 3, the present invention is a boat fender hanger. An objective of the present invention is to provide users with a device that can hold fenders alongside a boat in various locations. The present invention intends to provide users with a device that does not interfere with the space around a boat cleat. To accomplish this, the present invention comprises a mounting section and a hanger body. Many of these components allow for a fender to be positioned alongside a boat to protect it from hitting other boats and docks. The mounting section is positioned at the top side of the hanger body being sewn securely together as seen in FIG. 1. The mounting section comprises a metal bracket that allows the mounting section to be secured along the boat side wall. Thus, the present invention is a boat fender hanger that can hang anywhere alongside a boat to protect it while docking, ensuring the cleat of the boat stays unobstructed for utilization while securing the boat to the dock.

Figure 4:
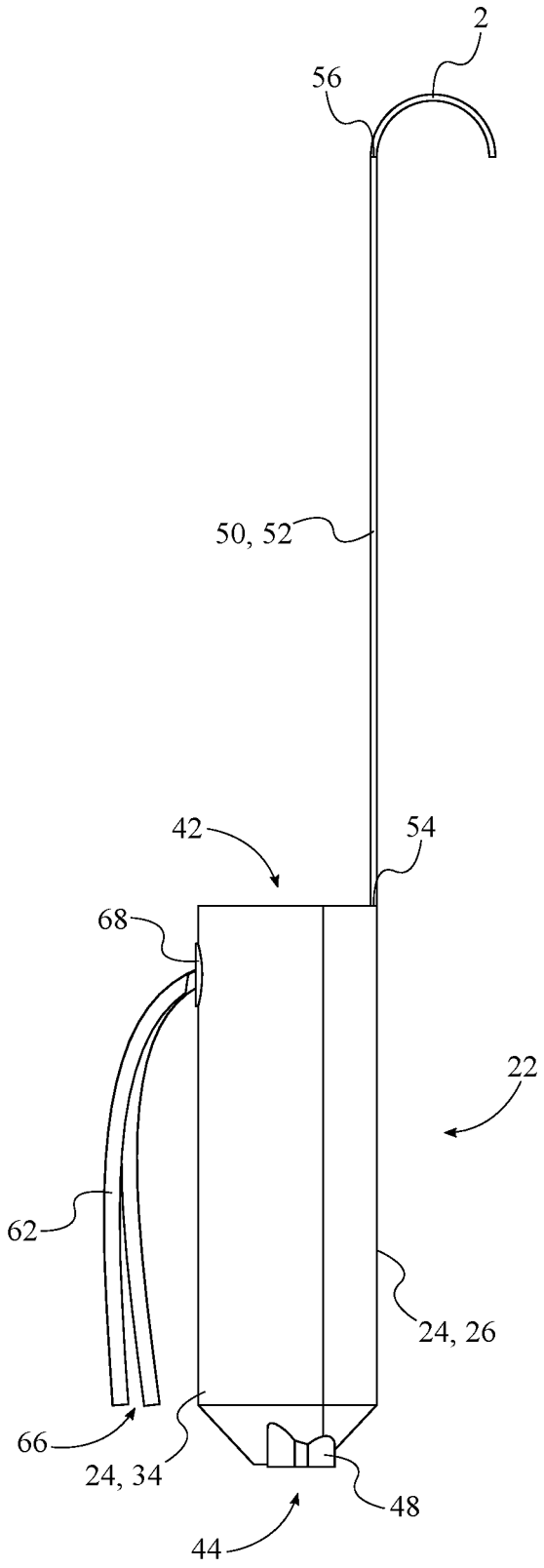
FIG. 4 is a left-side view of the exemplary embodiment of the present invention.
Figure 5:
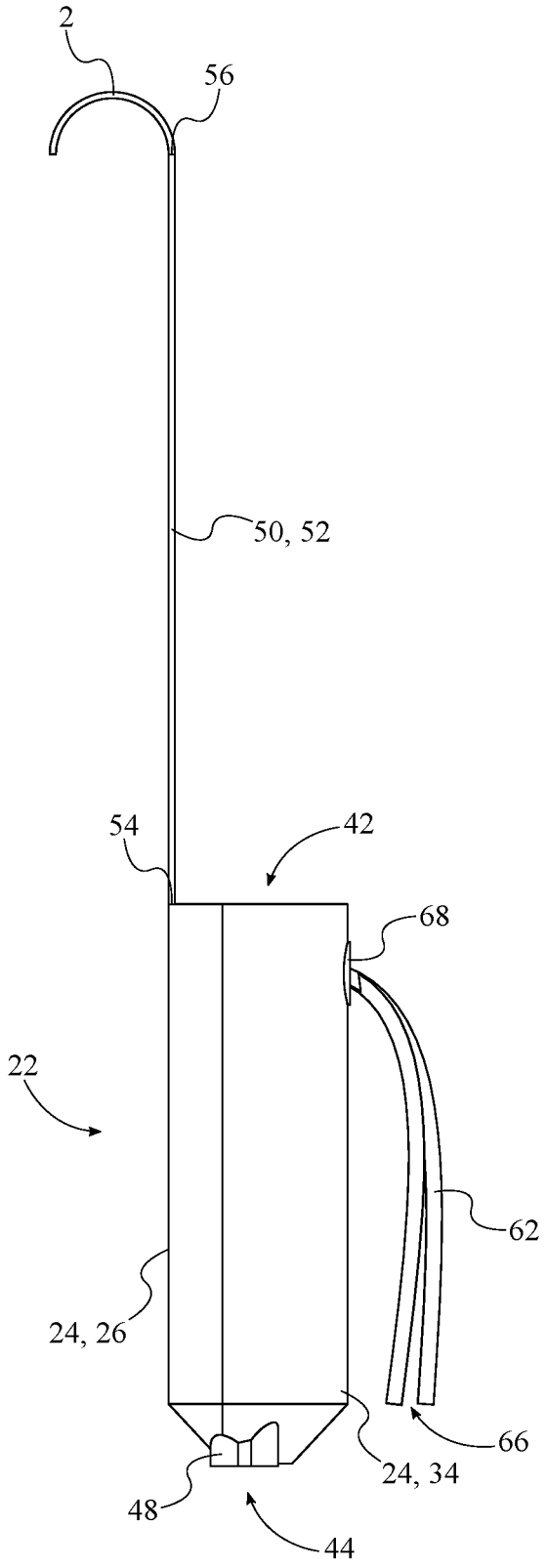
FIG. 5 is a right-side view of the exemplary embodiment of the present invention.

The present invention holds onto the side of a boat via the mounting section. The mounting section is made of a rigid canvas material that hangs easily along the side of the boat. In its preferred embodiment, the mounting section comprises a metal bracket and a bracket pocket. The bracket pocket is a horizontal opening along the side of the mounting section as shown in FIG. 5. The bracket pocket is a one-sided opening that is sewn shut on the other three sides, creating a rectangular pocket shape. The bracket pocket is designed to receive and secure a metal bracket. The metal bracket is designed as a curved metal section to create an upside-down J shape as shown in FIG. 4. The curved shape of the metal bracket ensures the mounting section can fit over and around common stainless-steel rails found along the sides of most boats. In an alternative embodiment the metal bracket is designed with a rectangular C-shape to fit around the square tubing found on most pontoon boats. Further, in a third alternative embodiment the mounting section is designed with a triangular shape with a horizontally centered O-ring. This design accommodates a spring-loaded pin mount seen on various custom boats. Furthermore, in a fourth alternative embodiment the mounting section is designed with a top sided slit that passes over the top of a cleat and rests snugly around the bottom of the cleat like a button and buttonhole. It should be further noted that, the mounting section can be created in many various shapes and sizes and the metal bracket could be designed with many variations while still staying within the scope of the present invention.

Figure 6:
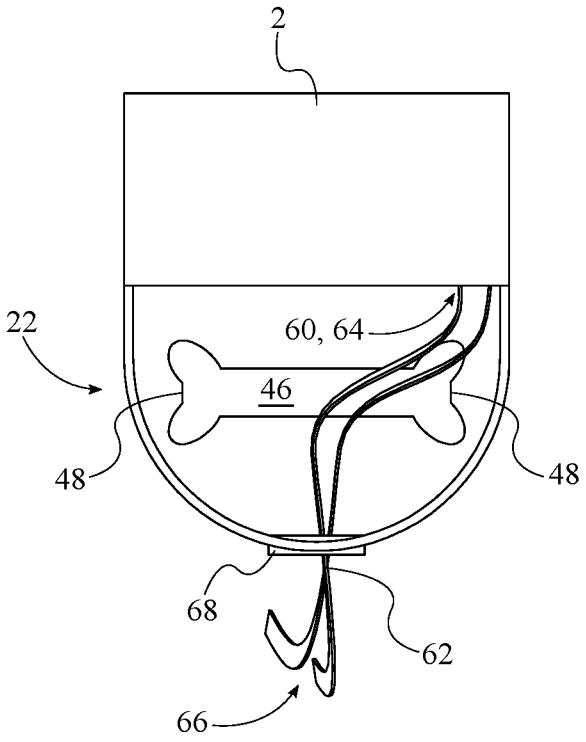
FIG. 6 is a top view of the exemplary embodiment of the present invention.
Figure 7:
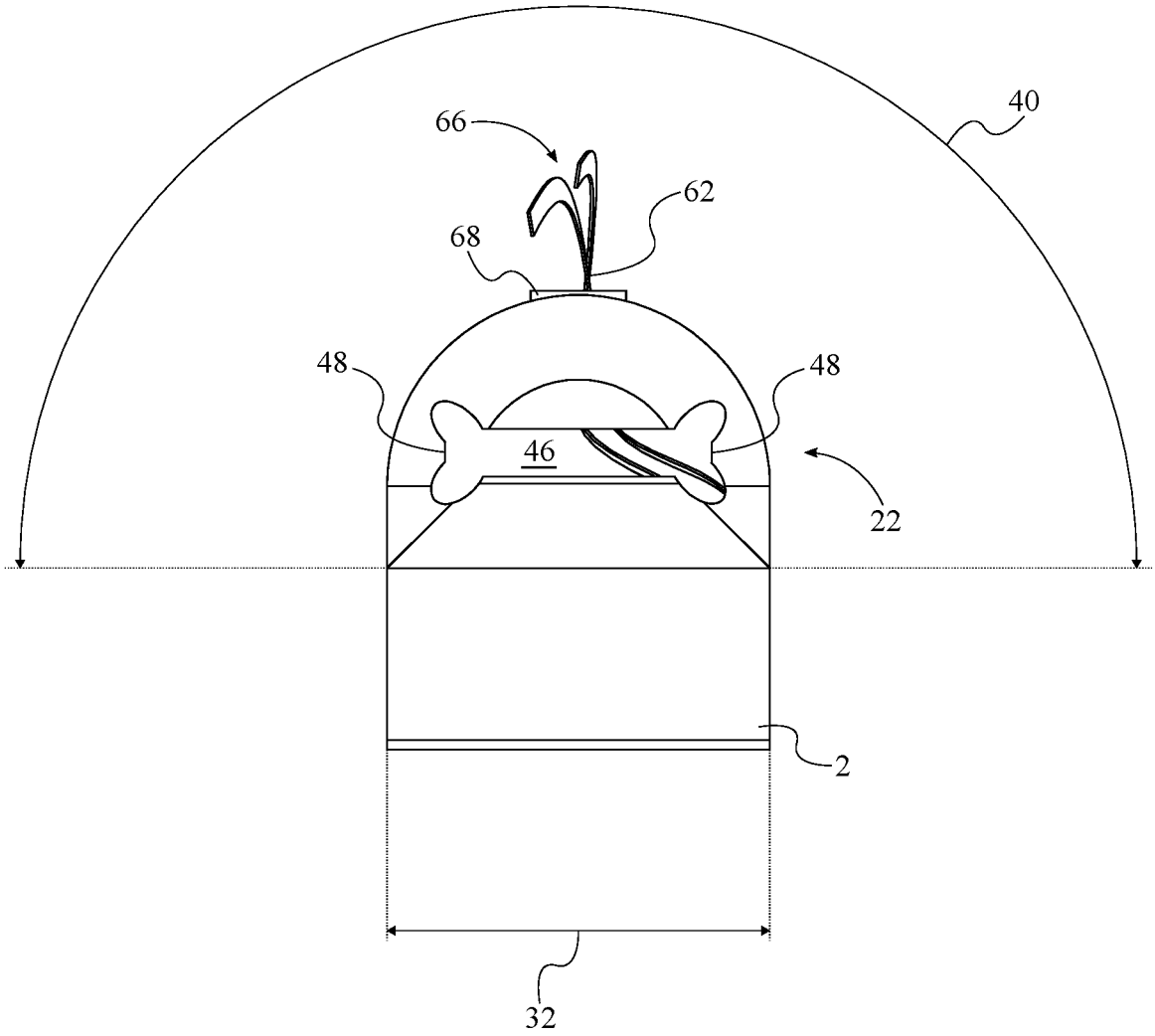
FIG. 7 is a bottom view of the exemplary embodiment of the present invention.

The hanger body connects at the bottom of the mounting section. The hanger body is made of a similar canvas material with a blue colored binding around the edges, but is not limited to, this color. This material allows the hanger body to hold and retain its shape while hanging well along the side of the boat. In its preferred embodiment the hanger body comprises a fender pocket, a lanyard, and an O-ring. The fender pocket is designed with a marine grade fabric that cradles various sized marine fenders of 6-, 8-, and 9-inch diameters within the fender pocket. The hanger body fabric extends upwards from the fender pocket to accommodate various sized boat sides. The fender pocket creates a cylindrical shaped pocket to fit various shaped boat fenders as seen in FIG. 6. The bottom of the fender pocket is pinched closed to ensure that any sized fender placed within the fender pocket cannot fall through. Positioned at the front of the fender pocket is the O-ring shown in FIG. 2. The O-ring is designed to work with the lanyard positioned at the bottom of the fender pocket to properly secure the fender within the fender pocket. The O-ring is designed with a metal circular shape that receives the end of the lanyard. The lanyard as seen in FIG. 7, is sewn into the bottom of the fender pocket and traverses through the O-ring to be tied to the fender. The lanyard is made of a cord material with a strength to secure the fender to the present invention. With all the components working in tandem with each other it can be seen that, the present invention is a boat fender hanger that can hang anywhere alongside a boat to protect it while docking, ensuring the cleat of the boat stays unobstructed for utilization while securing the boat to the dock.

Although the invention has been explained in relation to its preferred embodiment, it is to be understood that many other possible modifications and variations can be made without departing from the spirit and scope of the invention as hereinafter claimed.

What is claimed is:

1. A boat fender hanger comprising:

a hanging mechanism;

a fender-retaining sleeve;

a suspension band;

the fender-retaining sleeve comprising a sleeve body, an open sleeve end, a closed sleeve end, and a protrusion-receiving hole;

the suspension band comprising a band body, a proximal band end, and a distal band end;

the open sleeve end and the closed sleeve end being positioned opposite to each other along the sleeve body;

the proximal band end and the distal band end being positioned opposite to each other along the band body;

the proximal band end being laterally connected to the sleeve body, adjacent to the open sleeve end; and the hanging mechanism being integrated into the band body, adjacent to the distal band end;

the protrusion-receiving hole traversing through the closed sleeve end; and the protrusion-receiving hole being centrally positioned to the closed sleeve end.

2. The boat fender hanger as claimed in claim 1, wherein the fender-retaining sleeve and the suspension band are made of a marine-grade canvas.

3. The boat fender hanger as claimed in claim 1, wherein the fender-retaining sleeve and the suspension band are a blue color.

4. The boat fender hanger as claimed in claim 1 comprising:

the sleeve body comprising an elongated backing and a lateral bracing panel;

the elongated backing comprising a first lengthwise backing edge and a second lengthwise backing edge;

the lateral bracing panel comprising a first lengthwise panel edge and a second lengthwise panel edge;

a panel width between the first lengthwise panel edge and the second lengthwise panel edge being greater than a backing width between the first lengthwise backing edge and the second lengthwise backing edge;

the first lengthwise panel edge being connected along the first lengthwise backing edge; and the second lengthwise panel edge being connected along the second lengthwise backing edge.

5. The boat fender hanger as claimed in claim 4, wherein the elongated backing and the band body are a single elongated piece of contiguous material.

6. The boat fender hanger as claimed in claim 1 comprising:

the fender-retaining sleeve further comprising a plurality of pinch points;

the plurality of pinch points being integrated between the sleeve body and the closed sleeve end;

the plurality of pinch points being peripherally positioned around the closed sleeve end; and the sleeve body being configured to taper towards the closed sleeve end by the plurality of pinch points.

7. The boat fender hanger as claimed in claim 1 comprising:

a cord anchor;

at least one securing cord;

at least one cord eyelet;

the at least one securing cord comprising a proximal cord end and a distal cord end;

the cord anchor being connected within the sleeve body, adjacent to the closed sleeve end;

the at least one cord eyelet being integrated into the sleeve body, adjacent to the open sleeve end;

the at least one cord eyelet being positioned offset from the cord anchor about the sleeve body;

the proximal cord end being connected onto the cord anchor;

the at least one securing cord being positioned through the at least one cord eyelet; and the distal cord end being positioned external to the sleeve body.

8. The boat fender hanger as claimed in claim 7 comprising:

the at least one securing cord being a plurality of securing cords; and the distal cord end of each of the plurality of securing cords being connected onto the cord anchor.

9. The boat fender hanger as claimed in claim 7 comprising:

the at least one cord eyelet being a plurality of cord eyelets; and the plurality of cord eyelets being radially positioned about the cord anchor.

10. The boat fender hanger as claimed in claim 1 comprising:

the hanging mechanism comprising an internal pocket and a hooking bracket;

the internal pocket being integrated into the band body, adjacent to the distal band end;

the hooking bracket being positioned within the internal pocket;

the sleeve body being oriented away from the band body; and the hooking bracket being oriented away from the band body, opposite to the sleeve body.

11. The boat fender hanger as claimed in claim 10 comprising:

the hooking bracket comprising a concave bracket portion and a convex bracket portion;

the concave bracket portion being oriented towards the sleeve body; and the convex bracket portion being oriented away from the sleeve body.

12. The boat fender hanger as claimed in claim 1 comprising:

the hanging mechanism comprising an internal pocket, a hooking hole, and a support plate;

the internal pocket being integrated into the band body, adjacent to the distal band end;

the support plate being positioned within the internal pocket; and the hooking hole traversing through the band body and the support plate.

13. The boat fender hanger as claimed in claim 1 comprising:

the hanging mechanism comprising a hooking slit;

the hooking slit traversing normal through the band body;

the hooking slit being positioned perpendicular to a band length of the suspension band; and the hooking slit being positioned adjacent to the distal band end.

14. The boat fender hanger as claimed in claim 13 comprising:

the hanging mechanism further comprising a first elongated liner and a second elongated liner;

the first elongated liner and the second elongated liner being integrated into the band body;

the first elongated liner being positioned adjacent and along the hooking slit; and the second elongated liner being positioned adjacent and along the hooking slit, opposite to the first elongated liner.

* * * * *